US010808907B2

(12) United States Patent
Yamamoto et al.

(10) Patent No.: US 10,808,907 B2
(45) Date of Patent: Oct. 20, 2020

(54) VEHICULAR LAMP

(71) Applicant: STANLEY ELECTRIC CO., LTD., Tokyo (JP)

(72) Inventors: Takuya Yamamoto, Tokyo (JP); Marino Mine, Tokyo (JP); Haruna Minami, Tokyo (JP); Akihiko Hanya, Tokyo (JP); Kosaburo Ito, Tokyo (JP); Norifumi Imazeki, Tokyo (JP); Hiroyuki Chikama, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/548,544

(22) Filed: Aug. 22, 2019

(65) Prior Publication Data

US 2020/0063941 A1 Feb. 27, 2020

(30) Foreign Application Priority Data

Aug. 24, 2018 (JP) ..... 2018-157849

(51) Int. Cl.
*F21S 43/20* (2018.01)
*F21S 43/27* (2018.01)
(Continued)

(52) U.S. Cl.
CPC ..... *F21S 43/26* (2018.01); *F21S 43/14* (2018.01); *F21S 43/145* (2018.01); *F21S 43/245* (2018.01); *F21S 43/27* (2018.01); *F21Y 2107/10* (2016.08); *F21Y 2107/70* (2016.08); *F21Y 2115/10* (2016.08)

(58) Field of Classification Search
CPC ..... F21Y 2105/18; F21Y 2107/10; F21Y 2107/70; F21V 5/043; F21S 43/145; F21S 43/245
See application file for complete search history.

(56) References Cited

U.S. PATENT DOCUMENTS 6,520,669 B1 * 2/2003 Chen ..... B60Q 1/2696 362/545
2001/0019486 A1 * 9/2001 Thominet ..... F21S 41/255 362/543
(Continued)

FOREIGN PATENT DOCUMENTS

CN 106122866 A 11/2016
DE 10 2013 008 192 A1 11/2014
(Continued)

OTHER PUBLICATIONS

Extended European Search Report for the related European Patent Application No. 19193635.0 dated Jan. 27, 2020.

*Primary Examiner* — Alexander K Garlen
(74) *Attorney, Agent, or Firm* — Kenealy Vaidya LLP

(57) ABSTRACT

Provided is a vehicular lamp which has a novel lighting appearance and satisfies a light distribution standard required by certain laws as well as being capable of realizing lighting patterns of various luminances and various light-emitting shapes, e.g., various lighting graphics. The vehicular lamp is provided with a film light source including a film having flexibility and a plurality of semiconductor light-emitting elements fixed in a state of being two-dimensionally disposed on at least a surface of the film.

12 Claims, 13 Drawing Sheets

(51) Int. Cl.

| | |
|---|---|
| ***F21S 43/14*** | (2018.01) |
| ***F21S 43/245*** | (2018.01) |
| ***F21S 43/145*** | (2018.01) |
| ***F21Y 115/10*** | (2016.01) |
| ***F21Y 107/70*** | (2016.01) |
| ***F21Y 107/10*** | (2016.01) |

(56) References Cited

U.S. PATENT DOCUMENTS

| | | | | |
|---|---|---|---|---|
| 2013/0026504 | A1* | 1/2013 | Marx | F21K 9/00 257/88 |
| 2013/0107519 | A1 | 5/2013 | Kim et al. | |
| 2014/0209945 | A1* | 7/2014 | Baldridge | H01L 25/0753 257/91 |
| 2014/0264396 | A1* | 9/2014 | Lowenthal | H01L 33/08 257/88 |
| 2015/0023046 | A1 | 1/2015 | Shido et al. | |
| 2015/0131289 | A1* | 5/2015 | Speer | F21K 9/90 362/285 |
| 2015/0345740 | A1* | 12/2015 | Watanabe | F21S 43/30 362/517 |
| 2016/0218257 | A1* | 7/2016 | Ray | F21V 33/0008 |
| 2017/0108201 | A1* | 4/2017 | Shields | F21V 21/145 |
| 2017/0184264 | A1 | 6/2017 | Gomi | |
| 2017/0254518 | A1* | 9/2017 | Vasylyev | G02B 6/0083 |
| 2017/0365945 | A1* | 12/2017 | Speer | F21V 23/06 |
| 2019/0032894 | A1* | 1/2019 | Ho | F21V 19/0025 |

FOREIGN PATENT DOCUMENTS

| | | | |
|---|---|---|---|
| DE | 10 2013 223 717 | A1 | 5/2015 |
| EP | 3 187 775 | A1 | 7/2017 |
| FR | 3 056 284 | A1 | 3/2018 |
| JP | 2015-22917 | A | 2/2015 |
| JP | 2016-58136 | A | 4/2016 |

* cited by examiner

VEHICULAR LAMP

This application claims the priority benefit under 35 U.S.C. § 119 of Japanese Patent Application No. 2018-157849 filed on Aug. 24, 2018, which is hereby incorporated in its entirety by reference.

TECHNICAL FIELD

The presently disclosed subject matter relates to a vehicular lamp, and more particularly, to a vehicular lamp having a novel lighting appearance capable of satisfying a light distribution standard required by a certain law and realizing a lighting pattern of various luminances and various light emission shapes, e.g., various lighting graphics.

BACKGROUND ART

Conventionally, there have been proposed vehicular lamps using organic EL devices, for example, those disclosed in Japanese Patent Application Laid-Open No. 2016-058136. This publication discloses a vehicular lamp in which an organic EL panel capable of functioning as a tail lamp and an organic EL panel capable of functioning as a stop lamp are disposed side by side.

However, in the vehicular lamp disclosed in this publication, each of the organic EL panel capable of functioning as the tail lamp and the organic EL panel capable of functioning as the stop lamp is a monotonous lighting pattern that is formed only by turning on or off the lamp. This leads to a problem in which a complicated lighting pattern cannot be realized, and so it is difficult to realize a vehicular lamp having a novel lighting appearance. At present, the organic EL panel has low luminance and there is another problem in which it is difficult to satisfy the light distribution standard required by a certain law (particularly, in the case of a stop lamp or a turn signal lamp requiring high luminance) (for example, refer to Japanese Patent Application Laid-Open No. 2015-022917 (or U.S. Patent Application Publication No. 2015/0023046A1 corresponding thereto).

SUMMARY

The presently disclosed subject matter was devised in view of these and other problems and features in association with the conventional art. According to an aspect of the presently disclosed subject matter, there can be provided a vehicular lamp which has a novel lighting appearance and satisfies a light distribution standard required by certain laws as well as being capable of realizing lighting patterns of various luminances and various light-emitting shapes, e.g., various lighting graphics.

According to another aspect of the presently disclosed subject matter, there can be provided a vehicular lamp provided with a film light source including a film having flexibility and a plurality of semiconductor light-emitting elements fixed in a state of being two-dimensionally disposed on at least a surface of the film.

According to this aspect, there can be provided a vehicular lamp capable of satisfying the light distribution standard required by certain laws and having a novel lighting appearance that can realize various lighting patterns of various luminances and various light-emitting shapes, e.g., various lighting graphics.

Since the vehicular lamp includes the film light source including a plurality of semiconductor light-emitting elements fixed in a state of being disposed two-dimensionally (display-like) on at least a surface of the film, individually turning on or off the plurality of semiconductor light-emitting elements can realize lighting patterns of various luminances and various light-emitting shapes, e.g., various lighting graphics. The reason why the light distribution standard required by certain laws can be satisfied, in particular, in the case of a stop lamp or a turn signal lamp which is required to have a high luminance, is that the semiconductor light-emitting elements having a luminance higher than that of an organic EL are used.

In the presently disclosed subject matter, the vehicular lamp in a preferable mode is configured to further include a film light source supporting unit configured to support the film light source in such a state that the film maintains a constant shape.

According to this aspect, since the flexible film light source fixed in such a state that the plurality of semiconductor light-emitting elements are two-dimensionally disposed is used, it is possible to arrange all of the plurality of semiconductor light-emitting elements two-dimensionally or three-dimensionally in predetermined positions at once only by supporting the film light source in such a state that the film maintains a constant shape (for example, a curved shape) by the film light source supporting unit, as compared with a case where the plurality of semiconductor light-emitting elements are individually disposed at respective predetermined positions in respective predetermined postures.

In the presently disclosed subject matter, the vehicular lamp in a preferable mode is configured such that the film light source supporting unit includes a front lens, a rear lens, and a lens fixing unit configured to fix the front lens and the rear lens, and the lens fixing unit fixes the front lens and the rear lens in such a state that the film light source is disposed between the front lens and the rear lens.

According to this aspect, it is possible to configure a thin and lightweight lamp unit for use in the vehicular lamp according to the presently disclosed subject matter in which the front lens and the rear lens are fixed in such a state that the film light source is disposed between the front lens and the rear lens.

In the presently disclosed subject matter, the vehicular lamp in a preferable mode is configured such that the rear lens is curved, and the film light source is curved along the front surface of the rear lens by bringing the rear surface of the film light source into surface contact with the front surface of the rear lens.

According to this aspect, since the rear surface of the film light source and the front surface of the rear lens are in surface contact with each other, the shape of the film light source (film) can be kept constant (maintained in a curved shape).

Further, in the presently disclosed subject matter, the vehicular lamp in a preferable mode is configured such that the lens fixing unit fixes the front lens and the rear lens in such a state that the front surface of the film light source and the rear surface of the front lens face each other with a space interposed therebetween.

According to this aspect, since the front surface of the film light source and the rear surface of the front lens face each other with the space interposed therebetween, the front surface of the film light source where the plurality of semiconductor light-emitting elements are mounted is prevented from being damaged by such a contact with the rear surface of the front lens or the like.

In the presently disclosed subject matter, the vehicular lamp in a preferable mode is configured such that a first light distribution pattern is formed by controlling part or all of the plurality of semiconductor light-emitting elements to emit light in the first lighting pattern.

According to this aspect, the vehicular lamp can control the plurality of semiconductor light-emitting elements so that part or all of the plurality of semiconductor light-emitting elements emit light in the first lighting pattern to form the first light distribution pattern, for example, a light distribution pattern for a tail lamp.

In the presently disclosed subject matter, the vehicular lamp in a preferable mode is configured such that a second light distribution pattern is formed by controlling part or all of the plurality of semiconductor light-emitting elements to emit light in the second lighting pattern.

According to this aspect, a plurality of light distribution patterns can be formed by using a single film light source. For example, a first light distribution pattern, for example, a light distribution pattern for a tail lamp, can be formed by controlling part or all of the plurality of semiconductor light-emitting elements to emit light in the first lighting pattern. In addition, a second light distribution pattern, for example, a light distribution pattern for a stop lamp, can be formed by controlling part or all of the plurality of semiconductor light-emitting elements to emit light in the second lighting pattern.

Further, in the presently disclosed subject matter, the vehicular lamp in a preferable mode is configured to include a plurality of the film light sources, and the plurality of film light sources are disposed in a state of overlapping each other in the front-rear direction of the vehicle within a same range as viewed in a front view.

In the above-mentioned conventional technology (refer to Japanese Patent Application Laid-Open No. 2016-058136), since the organic EL panel functioning as the tail lamp and the organic EL panel functioning as the stop lamp are separately disposed side by side as viewed in a front view, the size of the vehicular lamp as viewed in a front view becomes large.

On the other hand, in this aspect, since the plurality of film light sources are disposed in such a state that they overlap each other in the front-rear direction of the vehicle within the same range as viewed in a front view, that is, in series in the front-rear direction of the vehicle, the size of the vehicular lamp in the front view can be reduced as compared with the case according to the above-mentioned conventional technology.

In addition, in the presently disclosed subject matter, the vehicular lamp in a preferable mode is configured such that the range within which the plurality of film light sources are disposed is a range satisfying the area requirement required by a certain law.

According to this aspect, the area requirement required by the law can be satisfied.

Further, in the presently disclosed subject matter, the vehicular lamp in a preferable mode is configured such that the semiconductor light-emitting elements of each of the plurality of film light sources are not mutually overlapped with the semiconductor light-emitting elements of the other film light source(s) as viewed in a front view, and are disposed in a state of overlapping with a film portion(s) of the other film light source(s) where no semiconductor light-emitting element is disposed.

According to this aspect, the light emitted forward from the semiconductor light-emitting elements of the film light source disposed rearward is transmitted through the film portion, where no semiconductor light-emitting element is disposed, of the film light source disposed in front thereof and irradiated forward without being obstructed or substantially obstructed by the semiconductor light-emitting elements of the film light source disposed forward. As a result, the light utilization efficiency of the light emitted forward from the semiconductor light-emitting elements of the film light source disposed rearward is improved.

In addition, according to this aspect, in contrast, the light emitted backward from the semiconductor light-emitting elements of the film light source disposed forward is transmitted through the film portion, where no semiconductor light-emitting element is disposed, of the film light source disposed rearward and irradiated rearward without being obstructed or substantially obstructed by the semiconductor light-emitting elements of the film light source disposed rearward. As a result, the light utilization efficiency of the light emitted backward from the semiconductor light-emitting elements of the film light source disposed forward is improved.

In the presently disclosed subject matter, the vehicular lamp in a preferable mode is configured such that the plurality of film light sources include at least a first film light source and a second film light source; the film light source supporting unit includes a front lens, an intermediate lens, a rear lens, and a lens fixing unit configured to fix the front lens, the intermediate lens, and the rear lens; and the lens fixing unit fixes the front lens, the intermediate lens, and the rear lens in such a state that the first film light source is disposed between the front lens and the intermediate lens, and that the second film light source is disposed between the intermediate lens and the rear lens.

According to this aspect, it is possible to configure a thin and lightweight lamp unit for use in the vehicular lamp according to the presently disclosed subject matter in which the front lens, the intermediate lens, and the rear lens are fixed in such a state that the film light source is disposed between the front lens and the intermediate lens, and the other film light source is disposed between the intermediate lens and the rear lens.

In the presently disclosed subject matter, the vehicular lamp in a preferable mode is configured such that the intermediate lens and the rear lens are curved, the first film light source is curved along the front surface of the intermediate lens by bringing the rear surface of the first film light source into surface contact with the front surface of the intermediate lens, and the second film light source is curved along the front surface of the rear lens by bringing the rear surface of the second film light source into surface contact with the front surface of the rear lens.

According to this aspect, since the rear surface of the first film light source and the front surface of the intermediate lens are in surface contact with each other, and the rear surface of the second film light source and the front surface of the rear lens are in surface contact with each other, the shapes of the first film light source and the second film light source (films) can be kept constant (maintained in a curved shape).

Further, in the presently disclosed subject matter, the vehicular lamp in a preferable mode is configured such the lens fixing unit fixes the front lens, the intermediate lens, and the rear lens in such a state that the front surface of the first film light source and the rear surface of the front lens face each other with a space interposed therebetween, and the front surface of the second film light source and the rear surface of the intermediate lens face each other with a space interposed therebetween.

According to this aspect, since the front surface of the first film light source and the rear surface of the front lens face each other with the space interposed therebetween, and also the front surface of the second film light source and the rear surface of the intermediate lens face each other with the space interposed therebetween, the front surface of the first film light source and the front surface of the second film light source where the plurality of semiconductor light-emitting elements are mounted on the respective front surfaces are prevented from being damaged by such a contact with the rear surface of the front lens and the rear surface of the intermediate lens, respectively.

Further, in the presently disclosed subject matter, the vehicular lamp in a preferable mode is configured such that the plurality of film light sources include at least a first film light source and a second film light source, and the emission color of the semiconductor light-emitting elements of the first film light source and the emission color of the semiconductor light-emitting elements of the second film light source are the same.

According to this aspect, a multi-functional vehicular lamp, for example, a tail lamp (red) and a stop lamp (red), can be realized even with the same color with a single lamp unit.

In the presently disclosed subject matter, the vehicular lamp in a preferable mode is configured such that the first light distribution pattern is formed by controlling part or all of the plurality of semiconductor light-emitting elements of the first film light source and the second film light source to emit light in a third lighting pattern.

According to this aspect, the vehicular lamp can control the plurality of semiconductor light-emitting elements of the first film light source and the second film light source so that part or all of the plurality of semiconductor light-emitting elements emit light in the third lighting pattern to form the first light distribution pattern, for example, a light distribution pattern for a tail lamp.

In the presently disclosed subject matter, the vehicular lamp in a preferable mode is configured such that the second light distribution pattern is formed by controlling part or all of the plurality of semiconductor light-emitting elements of the first film light source and the second film light source to emit light in a fourth lighting pattern.

According to this aspect, a first light distribution pattern, for example, a light distribution pattern for a tail lamp, can be formed by controlling part or all of the plurality of semiconductor light-emitting elements to emit light in the third lighting pattern. In addition, a second light distribution pattern, for example, a light distribution pattern for a stop lamp, can be formed by controlling part or all of the plurality of semiconductor light-emitting elements to emit light in the fourth lighting pattern.

Further, in the presently disclosed subject matter, the vehicular lamp in a preferable mode is configured such that the plurality of film light sources include at least a first film light source and a second film light source, and the emission color of the semiconductor light-emitting elements of the first film light source and the emission color of the semiconductor light-emitting elements of the second film light source are different from each other.

According to this aspect, a multi-functional vehicular lamp, for example, a tail lamp (red) and a turn-signal lamp (amber) can be realized even in different colors with a single lamp unit.

In the presently disclosed subject matter, the vehicular lamp in a preferable mode is configured such that the film is a transparent film.

According to this aspect, since the film of the film light source is a transparent film, light emitted backward by the semiconductor light-emitting elements of the film light source is transmitted through the film. As a result, the light utilization efficiency of the light emitted backward from the semiconductor light-emitting elements of the film light source is improved.

In the presently disclosed subject matter, the vehicular lamp in a preferable mode is configured such that the plurality of semiconductor light-emitting elements are each an LED chip, and the plurality of semiconductor light-emitting elements are mounted on the film in such a state that the surface of the LED chip on the side where an electrode pad is provided is opposed to the surface of the film.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
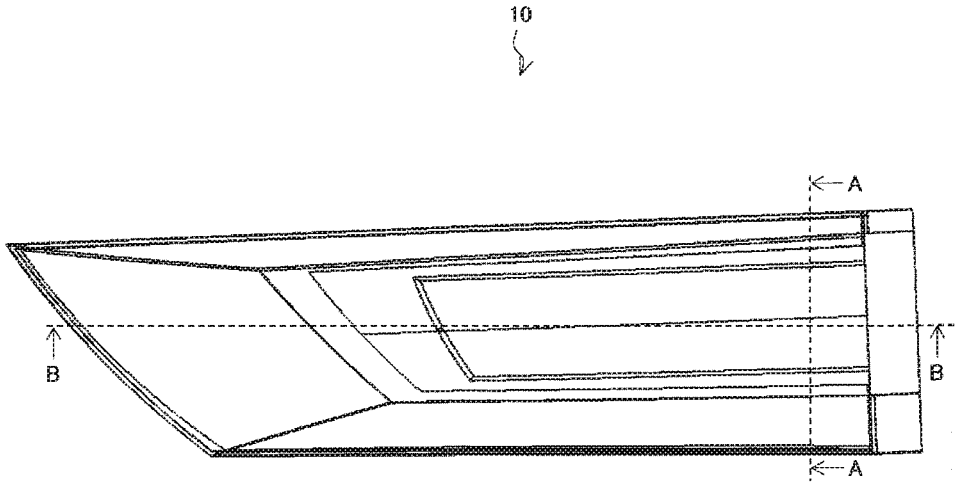
FIG. 1 is a front view of a vehicular lamp 10 made in accordance with principles of the presently disclosed subject matter.

A description will now be made below to vehicular lamps of the presently disclosed subject matter with reference to the accompanying drawings in accordance with exemplary embodiments. In the description, the constituent elements are denoted by respective reference numerals, and a redundant description thereof will be appropriately omitted.

FIG. 1 is a front view illustrating a vehicular lamp 10 made in accordance with the principles of the presently disclosed subject matter. The vehicular lamp 10 illustrated in FIG. 1 is, for example, a vehicular signal lamp which functions as a tail lamp and a stop lamp. The vehicular lamp 10 is mounted on each of the right and left sides of the rear end portion of a vehicle such as an automobile. Since the vehicular lamp 10 mounted on each of the left and right sides has a symmetrical configuration, the vehicular lamp 10 mounted on the left side of the rear end portion of the vehicle, i.e., the left side toward the front of the vehicle, will be described below as a representative. Hereinafter, for convenience of explanation, the term "forward" is used in the sense of the rear of the vehicle, and the term "rearward" is used in the sense of the front of the vehicle due to the vehicular lamp being mounted on the rear end portion of the vehicle.

Figure 2A:
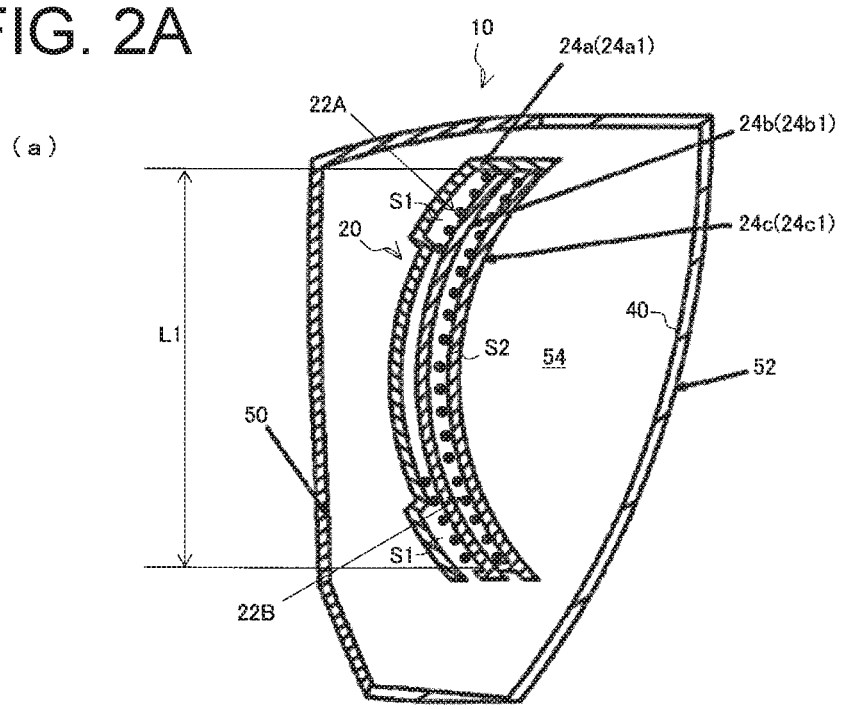
FIG. 2A is a cross-sectional view of the vehicular lamp 10 taken along line A-A in FIG. 1.
Figure 2B:
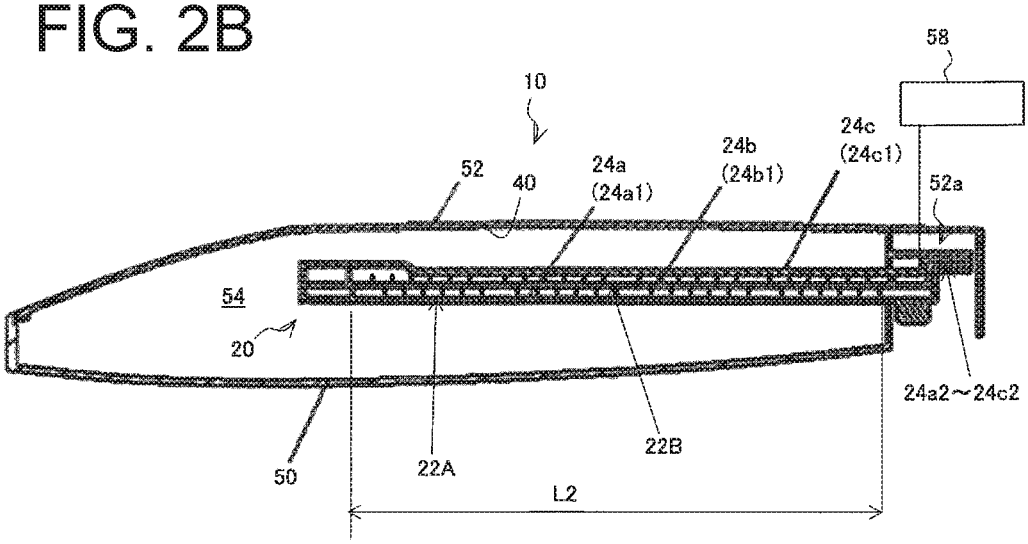
FIG. 2B is a cross-sectional view of the vehicular lamp 10 taken along line B-B in FIG. 1.

FIG. 2A is a cross-sectional view the vehicular lamp 10 taken along line A-A of FIG. 1 and FIG. 2B is a cross-sectional view of the same taken along line B-B of FIG. 1.

As shown in FIG. 2, the vehicular lamp 10 according to the present exemplary embodiment can include a lamp unit 20, a reflector 40, and the like. The lamp unit 20 can be disposed in a lamp chamber 54 defined by an outer lens 50 and a housing 52, and may be attached to the housing 52.

Figure 3:
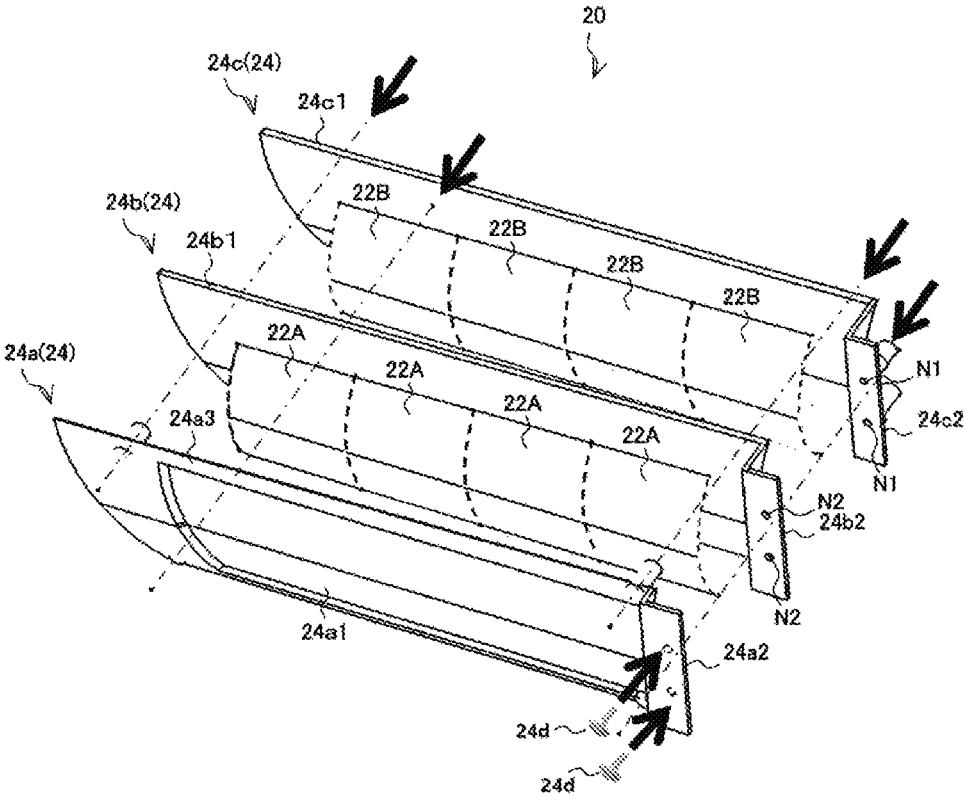
FIG. 3 is an exploded perspective view of a lamp unit 20 made in accordance with the principles of the presently disclosed subject matter.

FIG. 3 is an exploded perspective view of the lamp unit 20. As shown in FIG. 3, the lamp unit 20 includes a film light source 22A for a tail lamp (four in FIG. 3; hereinafter referred to as a first film light source 22A), a film light source 22B for a stop lamp (four in FIG. 3; hereinafter referred to as a second film light source 22B), and a film light source supporting unit 24 (24*a* to 24*c*).

Figure 4A:
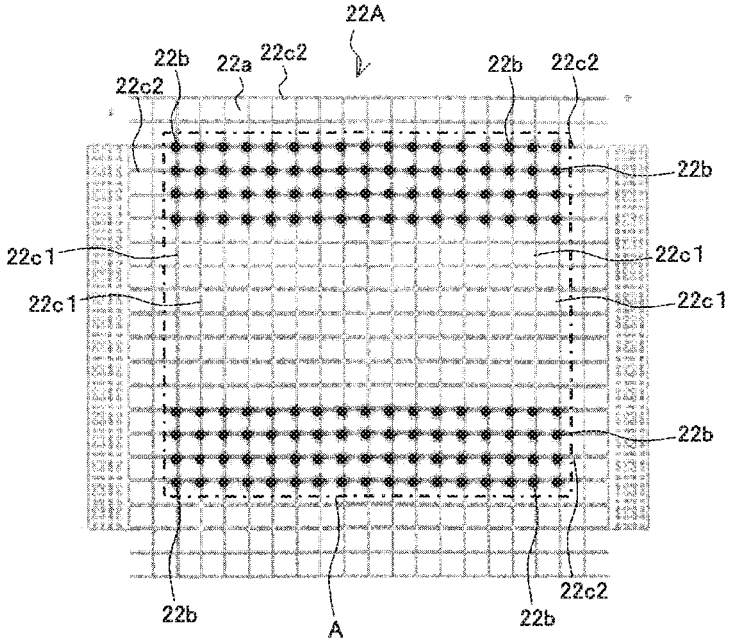
FIG. 4A is a front view of an example of a first film light source 22A used in the lamp unit of the vehicular lamp.
Figure 4B:
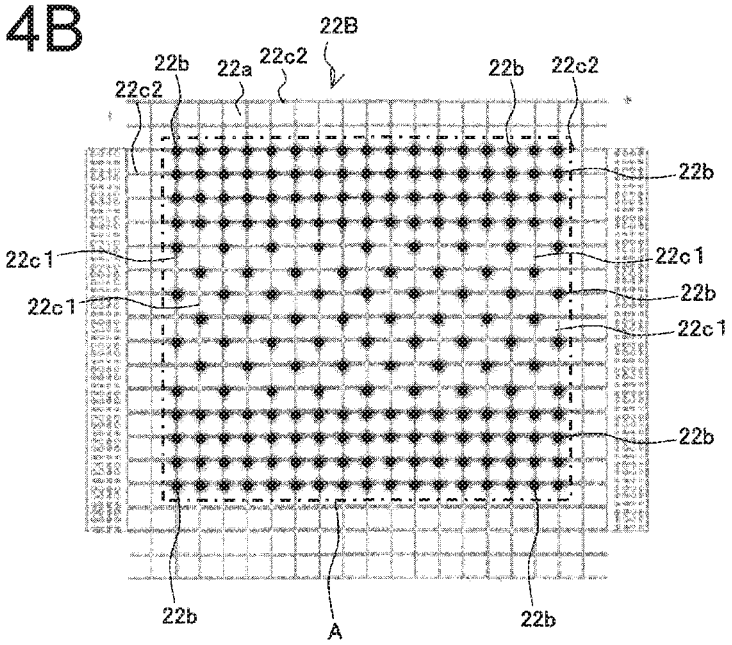
FIG. 4B is a front view of an example of a second film light source 22B used in the lamp unit of the vehicular lamp.

First, a film light source will be described with reference to FIGS. 4A and 4B. FIG. 4A is a front view of an example of the first film light source 22A used in the lamp unit 20 of the vehicular lamp 10, and FIG. 4B is a front view of an example of the second film light source 22B.

As shown in FIG. 4A, the first film light source 22A includes a film 22*a* and a plurality of semiconductor light-emitting elements 22*b*. Since the second film light source 22B has the same configuration as that of the first film light source 22A except that the number of semiconductor light-emitting elements 22*b* in the second film light source 22B is different from that in the first film light source 22A, the first film light source 22A will be described below as a representative. Note that the number of the semiconductor light-emitting elements 22*b* of the first film light source 22A and the number of the semiconductor light-emitting elements 22*b* of the second film light source 22B may be the same in some cases. The arrangement of the semiconductor light-emitting elements 22*b* of the first film light source 22A and the arrangement of the semiconductor light-emitting elements 22*b* of the second film light source 22B may be different from or the same as each other depending on the intended use applications.

The plurality of semiconductor light-emitting elements 22*b* are fixed (mounted) on the film 22*a* by, for example, bump-connecting the respective electrode pads thereof and a wiring pattern 22*c* formed on the film 22*a*. This will be described later.

The film 22*a* has a front surface and an opposite rear surface, and may be a transparent film having flexibility. The film 22*a* may be colorless and transparent, colored and transparent, or opaque. In the present exemplary embodiment, since the first and second film light sources 22A and 22B are disposed in a superimposed manner, the first film light source 22A disposed forward may adopt a transparent film used as the film 22*a* so that light rays Ray1 from the semiconductor light-emitting elements 22*b* of the second film light source 22B in the rear is transmitted therethrough. Also, the second film light source 22B may adopt a transparent film used as the film 22*a* so that light Ray2 from the semiconductor light-emitting elements 22*b* of the second film light source 22B is transmitted toward the rear reflector 40. The film 22*a* has a thickness of about 100 microns or less, and a rectangular outer shape, for example. Examples of the material of the film 22*a* may include polyimide, polyethylene terephthalate (PET), polyethylene naphthalate (PEN), cellulose nanofibers, and polyamideimide.

The film 22*a* has a wire pattern 22*c* (22*c*1, 22*c*2) formed thereon. The wiring pattern 22*c* may be made of metal such as silver, copper, gold, or the like, or a transparent wiring pattern made of ITO (indium tin oxide), for example.

The wiring pattern 22*c* includes a plurality of vertical wiring patterns 22*c*1 extending in the vertical direction and disposed side by side, and a plurality of horizontal wiring patterns 22*c*2 extending in the horizontal direction and disposed side by side. The vertical wiring patterns 22*c*1 and the horizontal wiring patterns 22*c*2 are disposed so as to intersect with each other to form a lattice pattern. The wiring pattern 22*c* may be formed in various aesthetic design patterns other than a lattice pattern, for example, aesthetic design patterns formed by straight lines and/or curved lines.

The vertical wiring patterns 22*c*1 are configured to supply a driving current to the respective semiconductor light-emitting elements 22*b*.

Figure 5:
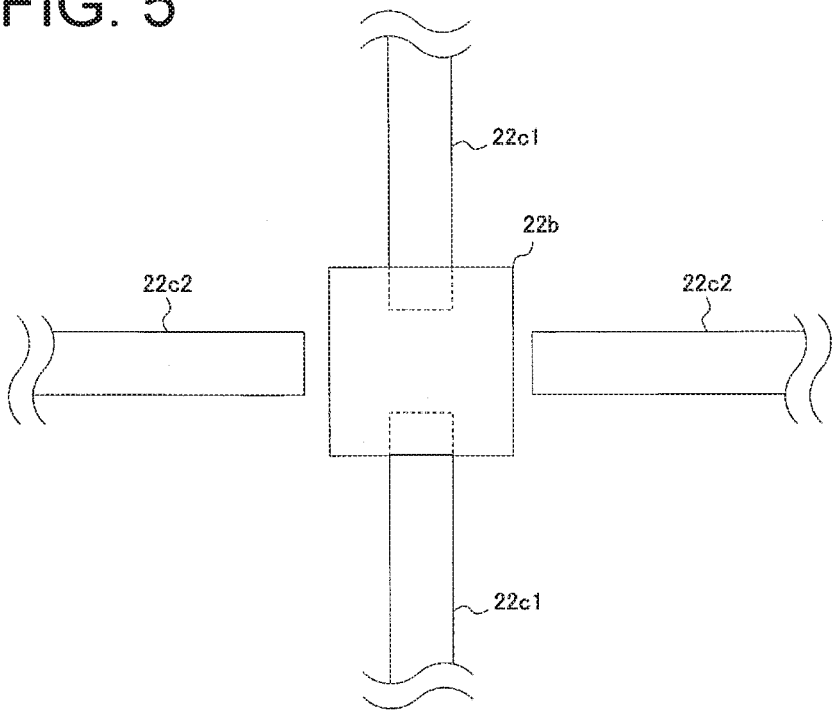
FIG. 5 is a partial enlarged view of a wiring pattern 22*c* around a semiconductor light-emitting element 22*b;*

FIG. 5 is a partial enlarged view of the wiring pattern 22*c* around a semiconductor light-emitting element 22*b*.

As shown in FIG. 5, the horizontal wiring pattern 22*c*2 is an intermittent wiring pattern which is interrupted in the vicinity of the vertical wiring pattern 22*c*1. The horizontal wiring pattern 22*c*2 is used for visually recognizing the entire wiring patterns 22*c* including the vertical wiring patterns 22*c*1 and the horizontal wiring patterns 22*c*2 as a lattice pattern as a whole (a so-called dummy wiring pattern), and is not configured to supply a driving current to the semiconductor light-emitting element 22*b*. It should be noted that the vertical wiring patterns 22*c*1 and the horizontal wiring patterns 22*c*2 also serve to dissipate heat generated in the semiconductor light-emitting elements 22*b* to which the drive current is supplied.

The wiring pattern 22*c* can be formed as follows.

First, a solution in which conductive particles (e.g., conductive nanoparticles) and an insulating material are dispersed or a solution in which conductive particles coated with an insulating material layer are dispersed is applied to the surface of the film 22*a* to form a film of conductive particles coated with the insulating material.

Next, the formed film is irradiated with a laser beam to be sintered. At this time, use of Ag, for example, as the conductive particles can form the wiring pattern 22*c* made of silver (for example, see Japanese Patent Application Laid-Open No. 2018-004995).

Further, for example, the wiring pattern 22*c* may be formed by forming a metal film of copper or the like on one surface of the film 22*a* and performing well-known etching on the metal film.

A plurality of semiconductor light-emitting elements 22*b* are mounted on the film 22*a*. Electronic components other than the semiconductor light-emitting element 22*b*, such as a resistor, may be mounted on the film 22*a* as appropriate.

In the present exemplary embodiment, the semiconductor light-emitting element 22*b* is a semiconductor light-emitting element having emission color of red (in the case where a tail lamp and a stop lamp are configured). The semiconductor light-emitting element 22*b* may be a semiconductor light-emitting element having emission color of amber (in the case where a turn signal lamp is configured), and may be a semiconductor light-emitting element having emission color of white (in the case where a reverse lamp is configured).

In the present exemplary embodiment, the semiconductor light-emitting element 22*b* is configured only by an LED chip (LED element). However, the semiconductor light-emitting element 22*b* may be configured by combining an LED chip and a wavelength conversion material such as a phosphor or a quantum dot, or may be configured by combining a plurality of LED chips.

The size of the semiconductor light-emitting element 22*b* is, for example, about 300 μm square. The outer shape of the semiconductor light-emitting element 22*b* may be a square, a rectangle, a triangle, or any other shape according to the intended use application.

The semiconductor light-emitting element 22*b* may include a substrate, an n-type semiconductor layer, a light emitting layer, a p-type semiconductor layer, an n-side electrode pad, a p-side electrode pad, and the like (not shown). Although the substrate may be transparent or opaque to light emitted from the light emitting layer, the substrate of the semiconductor light-emitting element 22*b* mounted in a flip-chip manner is preferably transparent. The substrate of the semiconductor light-emitting element 22*b* to be face-up mounted is preferably opaque, but may be transparent. The n-type semiconductor layer, the light-emitting layer, and the p-type semiconductor layer are stacked on the substrate. Hereinafter, the n-side electrode pad and the p-side electrode pad are correctively referred to as an electrode pad 22*b*1.

The semiconductor light-emitting elements 22*b* are fixed (flip-chip mounted) in such a state that the semiconductor light-emitting elements 22*b* are two-dimensionally disposed on at least one surface of the film 22*a*. For example, the semiconductor light-emitting elements 22*b* of the first film light source 22A are fixed to portions where a black circle is drawn in positions where the vertical wiring patterns 22*c*1 and the horizontal wiring patterns 22*c*2 intersect with each other in FIG. 4A. On the other hand, the semiconductor light-emitting elements 22*b* of the second film light source 22B are fixed to portions where a black circle is drawn in positions where the vertical wiring patterns 22*c*1 and the horizontal wiring patterns 22*c*2 intersect with each other in FIG. 4B.

In the present exemplary embodiment, the semiconductor light-emitting elements 22*b* are two-dimensionally disposed in a rectangular region A (see a region surrounded by a dot-dash line in FIGS. 4A and 4B) having an area of 50 $cm^2$, for example, in a front view in consideration of the area requirements required for stop lamps.

The interval at which the semiconductor light-emitting elements 22*b* are disposed (i.e., the interval between the adjacent vertical wiring patterns 22*c*1 and the interval between the adjacent horizontal wiring patterns 22*c*2) is, for example, 3 mm. The disposed positions of the semiconductor light-emitting elements 22*b* are not limited to the portions where the vertical wiring patterns 22*c*1 and the horizontal wiring patterns 22*c*2 intersect with each other, and the semiconductor light-emitting elements 22*b* may be disposed at various other positions in consideration of intended designs or the like.

Figure 6A:
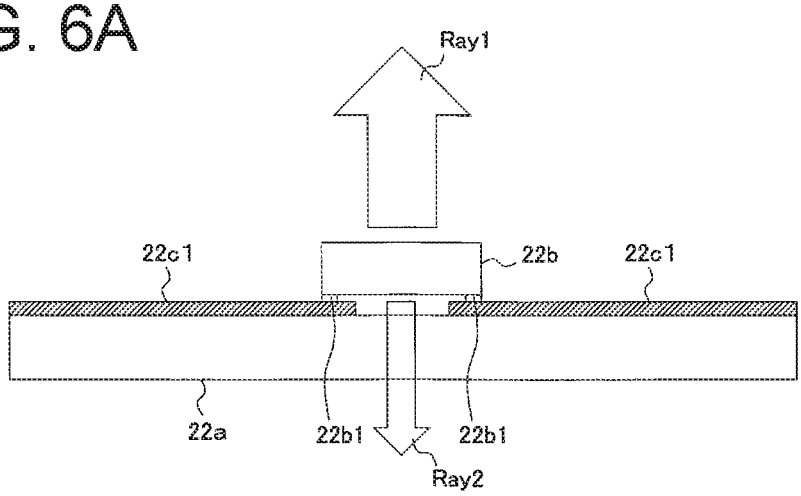
FIG. 6A is a diagram illustrating an example of flip-chip mounting.

FIG. 6A is a diagram illustrating an example of flip-chip mounting where one of the elements is illustrated as a part of the film light source for ease of understanding.

As shown in FIG. 6A, the semiconductor light-emitting element 22*b* is mounted on the film 22*a* in such a state that the surface on the side on which the electrode pad 22*b*1 is provided (hereinafter, referred to as an electrode surface) faces the surface of the film 22*a*, so that flip-chip mounting is achieved. Specifically, the semiconductor light-emitting element 22*b* is fixed to the film 22*a* by, for example, connecting the electrode pad 22*b*1 and the wiring pattern 22*c* (vertical wiring pattern 22*c*1) formed on the film 22*a* with the use of bump. Although not shown, the semiconductor light-emitting element 22*b* fixed to the film 22*a* may be sealed with a resin or covered with a cover member.

Figure 6B:
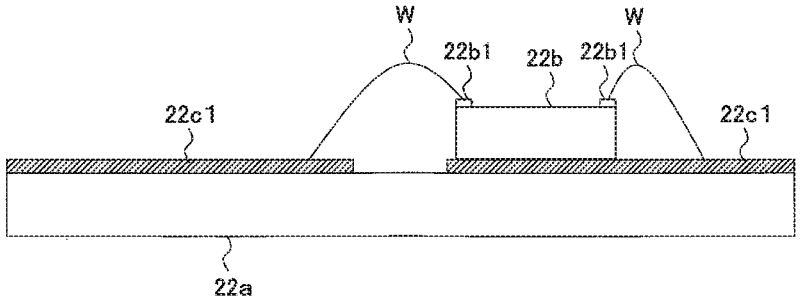
FIG. 6B is a diagram illustrating an example of face-up mounting.

FIG. 6B is a diagram illustrating an example of face-up mounting.

As shown in FIG. 6B, the semiconductor light-emitting element 22*b* may be mounted on the film 22*a* in such a state that the surface of the semiconductor light-emitting element 22*b* opposite to the electrode surface faces the surface of the film 22*a*, so that face-up mounting is achieved. In this case, the semiconductor light-emitting element 22*b* is fixed to the film 22*a* (or wiring pattern) by an adhesive such as a silver paste or resin. The electrode pad 22*b*1 and the wiring pattern 22*c* (vertical wiring pattern 22*c*1) are electrically connected by a metal wire W (double wire).

Figure 6C:
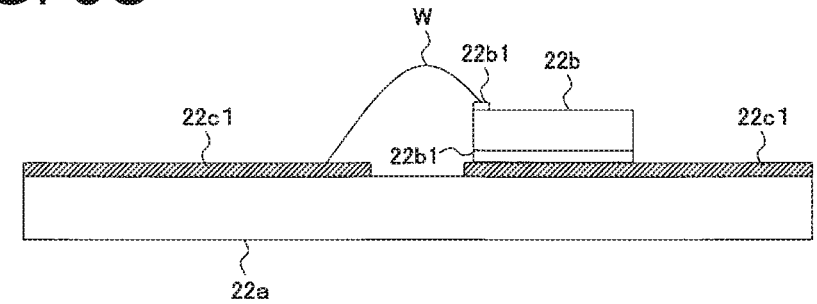
FIG. 6C is a diagram illustrating another example of face-up mounting.

FIG. 6C is a diagram illustrating another example of face-up mounting.

As the semiconductor light-emitting element 22*b*, the one in which the electrode pads 22*b*1 are disposed as shown in FIG. 6C may be used, and the semiconductor light-emitting element 22*b* may be mounted on the film 22*a* in such a state that the larger one of the electrode pads 22*b*1 facing each other faces the surface of the film 22*a*, so that face-up mounting is achieved. In this case, the semiconductor light-emitting element 22*b* is fixed to the wiring pattern (vertical wiring pattern 22*c*1) by a conductive adhesive such as a silver paste. The smaller electrode pad 22*b*1 and the wiring pattern 22*c* (vertical wiring pattern 22*c*1) are electrically connected by a metal wire W (single wire).

The semiconductor light-emitting element 22*b* emits light when a driving current is supplied through the wiring pattern 22*c* (vertical wiring pattern 22*c*1). As shown in FIG. 6A, the light emitted from the semiconductor light-emitting element 22*b* includes light rays Ray1 emitted from the surface opposite to the electrode surface and light rays Ray2 emitted from the electrode surface.

The ratio of the light rays Ray1 emitted from the surface opposed to the electrode surface to the light rays Ray2 emitted from the electrode surface differs depending on the structures of the light-emitting element 22*b* and the like, but is, for example, 7:3. The thickness of the arrow in FIG. 6A represents this ratio.

As shown in FIG. 6B and FIG. 6C, when the semiconductor light-emitting element 22*b* is mounted in a face-up manner, the film light source serves as a light source that emits light only from one surface. In this case, use of silver or a reflective silver paste for material of the vertical wiring pattern 22*c*1 or adhesive therefor can reflect light from the semiconductor light-emitting element 22*b* toward the film 22*a*, so that the light is emitted from the surface opposite to the side where the film 22*a* is provided.

It should be noted that, as shown in FIGS. 6B and 6C, even when the semiconductor light-emitting element 22*b* is face-up mounted, use of a transparent substrate as a substrate for the semiconductor light-emitting element 22*b* as well as use of a transparent adhesive as an adhesive for bonding the semiconductor light-emitting element 22*b* and the film 22*a* (or wiring pattern) can configure a film light source that can emit light from both surfaces as in the case shown in FIG. 6A.

Next, the film light source supporting unit 24 will be described.

The film light source supporting unit 24 can support the first and second film light sources 22A and 22B in such a state that the film 22*a* maintains a constant shape, for example, a planar shape or a curved shape. As shown in FIG. 3, the film light source supporting unit 24 includes a front lens 24*a*, an intermediate lens 24*b*, a rear lens 24*c*, and a lens fixing unit 24*d* such as a screw. In FIG. 3, the lens fixing unit 24*d* is illustrated as screws before fixed. The material of each of the lenses 24*a* to 24*c* is a transparent resin such as an acrylic resin or a polycarbonate resin.

As shown in FIG. 3, the intermediate lens 24*b* includes a lens body 24*b*1 and a flange portion 24*b*2. The lens body 24*b*1 is a lens having a shape in which a transparent plate is curved so that a longitudinal cross section thereof is convex toward the front (see FIG. 2A) and a transverse cross section thereof is straight (see FIG. 2B). The first film light source 22A is positioned with respect to the intermediate lens 24*b*, and is fixed to the intermediate lens 24*b* in such a state that the rear surface thereof and the front surface of the intermediate lens 24*b* face each other as shown in FIG. 3, for example, in such a state that they are in close contact or substantially in close contact with each other with a double-sided tape. As a result, the film light source 22A is supported in a curved state along the intermediate lens 24*b*. The first film light source 22A may be held in between the front lens 24*a* and the intermediate lens 24*b*.

Like the intermediate lens 24*b*, the rear lens 24*c* includes a lens body 24*c*1 and a flange portion 24*c*2. The lens body 24*c*1 is a lens having a shape in which a transparent plate is curved so that a longitudinal cross section thereof is convex toward the front (see FIG. 2A) and a transverse cross section thereof is straight (see FIG. 2B). The second film light source 22B is positioned with respect to the rear lens 24*c*, and is fixed to the rear lens 24*c* in such a state that the rear surface thereof and the front surface of the rear lens 24*c* face each other as shown in FIG. 3, for example, in such a state that they are in close contact or substantially in close contact with each other with a double-sided tape. As a result, the second film light source 22B is supported in a curved state along the rear lens 24*c*. The first film light source 22A may be held in between the front lens 24*a* and the intermediate lens 24*b*.

The front lens 24*a* includes a lens body 24*a*1, a flange portion 24*a*2, and a frame portion 24*a*3 surrounding the lens body 24*a*1. The lens body 24*a*1 is a lens having a shape in which a transparent plate is curved so that a longitudinal cross section thereof is convex toward the front (see FIG. 2A) and a transverse cross section thereof is straight (see FIG. 2B). The frame portion 24*a*3 may be decorated by aluminum deposition or the like, or may be a non-decorative transparent plate. By using a transparent material for the lenses 24*a*, 24*b*, and 24*c* and the film 22*a* of the first and second film light sources 22A and 22B, it is possible to make it difficult to recognize the presence of the light source when the light source (e.g., the semiconductor light-emitting elements 22*b*) is not emitting light.

The lens fixing unit 24*d* is a part configured to fix the front lens 24*a*, the intermediate lens 24*b*, and the rear lens 24*c* in a state of being positioned with respect to each other, and may be a screw or the like part.

Figure 7:
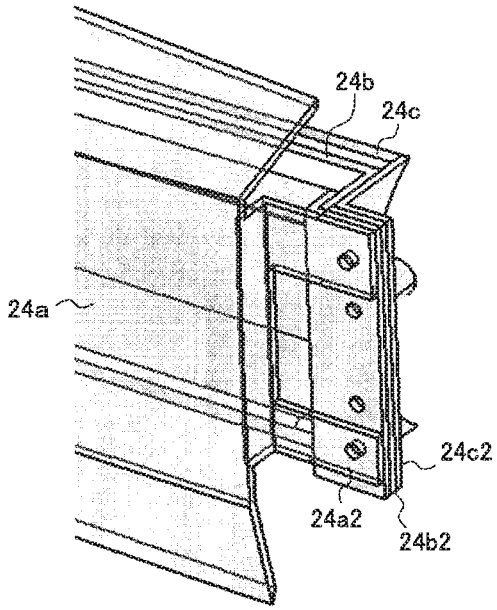
FIG. 7 is a perspective view of respective flange portions 24*a*2 to 24*c*2 in an overlapped state with one another.

For example, the front lens 24*a*, the intermediate lens 24*b*, and the rear lens 24*c* are positioned and fixed to each other by inserting and screwing screws 24*d* as the lens fixing unit 24*d* into screw holes N1 formed in the rear lens 24*c* at its flange portion 24*c*2 and screw holes N2 formed in the intermediate lens 24*b* at its flange portion 24*b*2 in such a state that the front surface of the first film light source 22A (semiconductor light-emitting elements 22*b*) and the rear surface of the front lens 24*a* face each other with a space S1 (see FIG. 2A) interposed therebetween, that the front surface of the second film light source 22B (semiconductor light-emitting elements 22*b*) and the rear surface of the intermediate lens 24*b* face each other with a space S2 (see FIG. 2A) interposed therebetween, and that the flange portions 24*a* to 24*c* of the lenses 24*a* to 24*c* are overlapped with one another as shown in FIG. 7. FIG. 7 is a perspective view of the respective flange portions 24*a*2 to 24*c*2 in an overlapped state with one another. It should be noted that the portions at which the lenses 24*a* to 24*c* are screwed are not limited to two portions. For example, as shown by six arrows in FIG. 3, there may be six portions.

Figure 8:
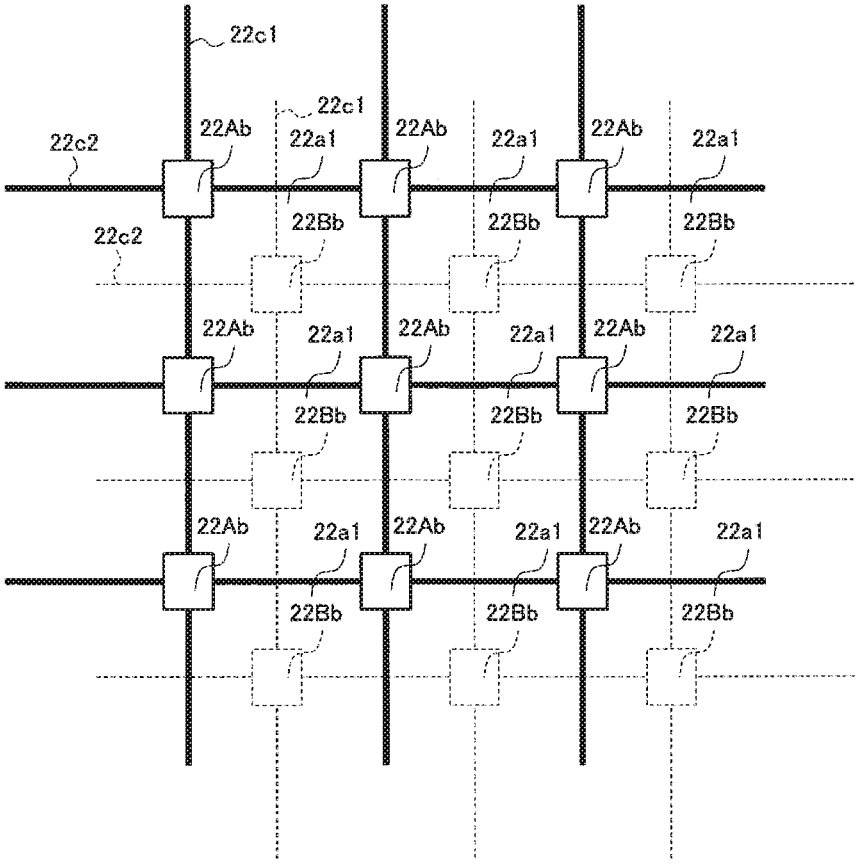
FIG. 8 is a perspective front view of the first film light source 22A and the second film light source 22B disposed behind the first film light source 22A.

FIG. 8 is a perspective front view of the first film light source 22A and the second film light source 22B disposed behind the first film light source 22A. In FIG. 8, reference numeral 22Ab denotes the semiconductor light-emitting elements 22*b* of the first film light source 22A, and reference numeral 22Bb denotes the semiconductor light-emitting elements 22*b* of the second film light source 22B.

As described above, when the lenses 24*a* to 24*c* are screwed and fixed, the first and second film light sources 22A and 22B are disposed in such a state that they overlap in the front-rear direction of a vehicle (that is, in series in the front-rear direction of the vehicle) within the same range (refer to the ranges indicated by the reference numerals L1 and L2 in FIGS. 2A and 2B) in a front view, as illustrated in FIGS. 2A and 2B. The same range refers to a range that meets the area requirements of a certain law, for example, 50 $cm^2$ for stop lamps.

The advantage of disposing the first and second film light sources 22A and 22B in the overlapping state in the front-rear direction of the vehicle within the same range as viewed in a front view is as follows.

For example, in the above-mentioned conventional technology (refer to Japanese Patent Application Laid-Open No. 2016-058136), since the organic EL panel functioning as the tail lamp and the organic EL panel functioning as the stop lamp are separately disposed side by side as viewed in a front view, the size of the vehicular lamp as viewed in a front view becomes large.

On the other hand, in the present exemplary embodiment, since the first and second film light sources 22A and 22B are disposed in such a state that they overlap each other in the front-rear direction of the vehicle within the same range as viewed in a front view, that is, in series in the front-rear direction of the vehicle, the size of the vehicular lamp in the front view can be reduced as compared with the case according to the above-mentioned conventional technology.

In addition, in such a state that the lenses 24*a* to 24*c* are screwed and fixed as described above, the semiconductor light-emitting elements 22*b* (e.g., semiconductor light-emitting elements 22Bb) of the first and second film light sources 22A and 22B are disposed such that they do not mutually overlap with the semiconductor light-emitting elements 22*b*

(e.g., semiconductor light-emitting elements 22Ab) and the wiring pattern 22*c* of the other film light source in a front view, and that they overlap with a film portion 22*a*1 of the other film light source where no semiconductor light-emitting element (22Ab) is disposed as illustrated in FIG. 8. The semiconductor light-emitting elements 22*b* of one film light source are disposed at positions surrounded by the semiconductor light-emitting elements 22*b* of the other film light source as viewed in a front view, as illustrated in FIG. 8. That is, the semiconductor light-emitting elements 22Ab (22Bb) are each disposed at a position surrounded by the semiconductor light-emitting elements 22B*b* (22Ab) as viewed in a front view.

As a result, the light rays Ray1 emitted forward from the semiconductor light-emitting elements 22*b* (22Bb) of the second film light source 22B disposed rearward are transmitted through the film portions 22*a*1, where no semiconductor light-emitting element is disposed, between the semiconductor light-emitting elements 22*b* (22Ab) of the first film light source 22A disposed forward without being obstructed or substantially obstructed by the semiconductor light-emitting elements 22*b* (22Ab) and the wiring pattern 22*c* of the first film light source 22A disposed forward. As a result, the light utilization efficiency of the light rays Ray1 emitted forward from the semiconductor light-emitting elements 22*b* (22Bb) of the second film light source 22B disposed rearward is improved.

On the contrary, the light rays Ray2 emitted backward from the semiconductor light-emitting elements 22*b* (22Ab) of the first film light source 22A disposed forward are transmitted through the film portions, where no semiconductor light-emitting element is disposed, between the semiconductor light-emitting elements 22*b* (22Bb) of the second film light source 22B disposed rearward and irradiated rearward without being obstructed or substantially obstructed by the semiconductor light-emitting elements 22*b* (22Bb) and the wiring pattern 22*c* of the second film light source 22B disposed rearward. As a result, the light utilization efficiency of the light rays Ray2 emitted backward from the semiconductor light-emitting elements 22*b* (22Ab) of the first film light source 22A disposed forward is improved.

Figure 9:
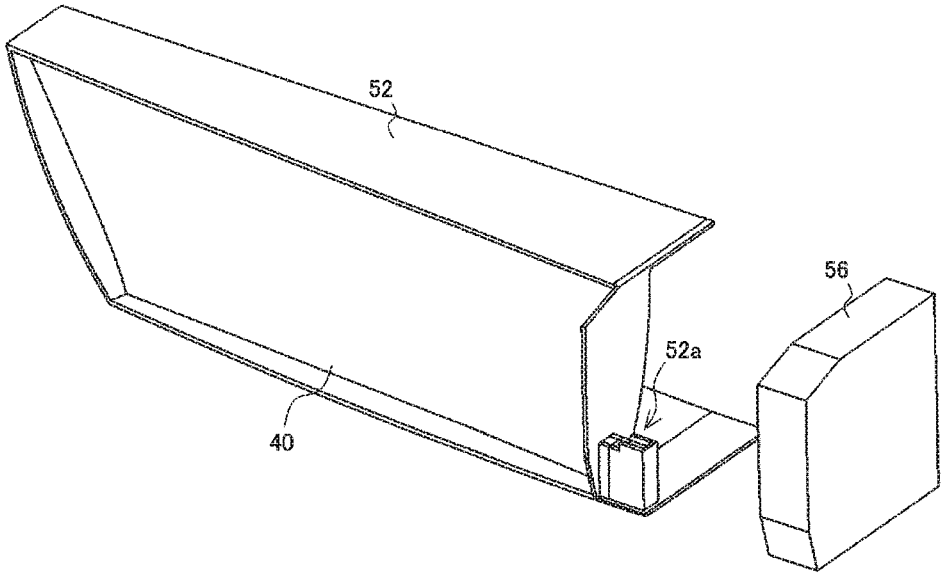
FIG. 9 is a perspective view of a housing 52 in the lamp unit of the vehicular lamp.

FIG. 9 is a perspective view of the housing 52.

The lamp unit 20 configured as described above is fixed in a state of being positioned in the housing 52. Specifically, the lamp unit 20 is fixed in a state of being positioned in the housing 52 by fitting the respective flange portions 24*a*2 to 24*c*2 (see FIG. 7) superposed as described above into a groove portion 52*a* (see FIG. 9) formed in the housing 52 (see FIG. 2B). Each of the flange portions 24*a*2 to 24*c*2 corresponds to a lamp unit supporting unit.

As a result, the lamp unit 20 is placed in the lamp chamber 54 with a space between the housing 52 (see FIGS. 2A and 2B). The groove portion 52*a* into which the flange portions 24*a*2 to 24*c*2 are fitted may be covered with an extension 56 (see FIG. 9).

As illustrated in FIGS. 2A and 2B, the reflector 40 is disposed behind the lamp unit 20. The reflector 40 can be formed as a part of the housing by, for example, performing embossing on the front surface of the housing 52 and depositing aluminum by evaporation on the embossed front surface of the housing 52.

The reflector 40 is provided so as to face the rear surface of the film 22*a* of the second film light source 22B, so that it can reflect the light rays Ray2 emitted from part or all of the plurality of semiconductor light-emitting elements 22*b* and transmitted through the film 22*a*. Specifically, the reflector 40 can reflect the light rays Ray2 emitted from the electrode surface of the semiconductor light-emitting elements 22*b* (22Ba) of the first film light source 22A and irradiated backward through the film portion, where no element is disposed, of the second film light source 22B, and the light rays Ray2 emitted from the electrode surface of the semiconductor light-emitting elements 22*b* (22Bb) of the second film light source 22B and irradiated backward. The reflector 40 may be omitted as appropriate according to intended use applications.

Next, lighting patterns by the first and second film light sources 22A and 22B, i.e., the semiconductor light-emitting elements 22*b* (22Ab and 22Bb), will be described. The first and second film light sources 22A and 22B are connected to a control device 58 (see FIG. 2B) configured to control the light emitting state (lighting state) of the respective semiconductor light-emitting elements 22*b*.

First, an example of a lighting pattern when the vehicular lamp 10 functions as a tail lamp will be described.

When the vehicular lamp 10 is caused to function as a tail lamp, part or all of the semiconductor light-emitting elements 22*b* of the first film light source 22A and the second film light source 22B are controlled to emit light in a first lighting pattern.

Although not limited thereto, the first lighting pattern is, for example, a pattern in which all the semiconductor light-emitting elements 22*b* of the first film light source 22A (see portions drawn with a black circle in FIG. 4A) and all the semiconductor light-emitting elements 22*b* of the second film light source 22B (see portions drawn with a black circle in FIG. 4B) are controlled to emit light at a first luminance. For example, as another mode of the first lighting pattern, a lighting pattern in which some of the semiconductor light-emitting elements 22*b* are turned off or dimmed may be used. As still another mode of the first lighting pattern, a lighting pattern in which luminance changes in a gradation manner as a whole may be used. As further another mode of the first lighting pattern, a lighting pattern in which the luminance of each semiconductor light-emitting element 22*b* is controlled to be changed may be used. This makes it possible to express a sense of perspective (sense of depth).

The first lighting pattern is not limited to a static lighting pattern, and may be a dynamic lighting pattern in which luminance, light emission shape, light emission position, and the like change with time.

As described above, when the semiconductor light-emitting elements 22*b* of the first film light source 22A and the second film light source 22B are controlled to emit light in the first lighting pattern, the light rays Ray1 emitted forward from the semiconductor light-emitting elements 22*b* (22Ab) of the first film light source 22A disposed forward, and the light rays Ray1 emitted forward from the semiconductor light-emitting elements 22*b* (22Bb) of the second film light source 22B disposed rearward and irradiated forward through the film portion 22*a*1 of the first film light source 22A disposed forward can form a light distribution pattern for a tail lamp.

In addition, the light rays Ray2 emitted backward from the semiconductor light-emitting elements 22*b* (22Bb) of the second film light source 22B disposed rearward, and the light rays Ray2 emitted backward from the semiconductor light-emitting elements 22*b* (22Ab) of the first film light source 22A disposed forward and irradiated backward through the film portion of the second film light source 22B disposed rearward are reflected by the reflector 40, whereby the reflector 40 can be observed as if it were emitting light.

As described above, when the vehicular lamp 10 is to function as a tail lamp, the first film light source 22A and the second film light source 22B can emit light, and further the reflector 40 can be observed as if it were emitting light, so that the second film light source 22B and the reflector 40 which are behind the first film light source 22A and light rays from which pass through the first film light source 22A can be visually recognized. As a result, a stereoscopic lighting appearance having a sense of depth can be realized.

As described above, the film light source supporting unit 24 (24*a* to 24*c*) can support the first and second film light sources 22A and 22B in a state of maintaining a constant shape, for example, a curved shape, of the film light sources. As a result, the semiconductor light-emitting elements 22*b* of the first and second film light sources 22A and 22B are disposed in a three-dimensional manner. This also realizes a stereoscopic lighting appearance having a sense of depth.

In addition, since the lamp unit 20 is placed in the lamp chamber 54 while keeping a space between it and the housing 52, it is possible to realize a lighting appearance that is seen as if the lamp unit 20 were floating in the lamp chamber 54.

Next, an example of a lighting pattern when the vehicular lamp 10 functions as a stop lamp will be described.

When the vehicular lamp 10 is caused to function as a stop lamp, part or all of the semiconductor light-emitting elements 22*b* of the first film light source 22A and the second film light source 22B are controlled to emit light in a second lighting pattern which is different from the first lighting pattern.

Although not limited thereto, the second lighting pattern is, for example, a pattern in which all the semiconductor light-emitting elements 22*b* of the first film light source 22A (see portions drawn with a black circle in FIG. 4A) and all the semiconductor light-emitting elements 22*b* of the second film light source 22B (see portions drawn with a black circle in FIG. 4B) are controlled to emit light at a second luminance (where the second luminance>the first luminance). For example, as another mode of the second lighting pattern, a lighting pattern in which part of the semiconductor light-emitting elements 22*b* is turned off or dimmed may be used. As still another mode of the second lighting pattern, a lighting pattern in which luminance changes in a gradation manner as a whole may be used. As further another mode of the second lighting pattern, a lighting pattern in which the luminance of each semiconductor light-emitting element 22*b* is controlled to be changed may be used. This makes it possible to express a sense of perspective (sense of depth).

The second lighting pattern is not limited to a static lighting pattern, and may be a dynamic lighting pattern in which luminance, light emission shape, light emission position, and the like change with time.

As described above, when the semiconductor light-emitting elements 22*b* of the first film light source 22A and the second film light source 22B are controlled to emit light in the second lighting pattern, the light rays Ray1 emitted forward from the semiconductor light-emitting elements 22*b* (22Ab) of the first film light source 22A disposed forward, and the light rays Ray1 emitted forward from the semiconductor light-emitting elements 22*b* (22Bb) of the second film light source 22B disposed rearward and irradiated forward through the film portion 22*a*1 of the first film light source 22A disposed forward can form a light distribution pattern for a stop lamp.

In addition, the light rays Ray2 emitted backward from the semiconductor light-emitting elements 22*b* (22Bb) of the second film light source 22B disposed rearward, and the light rays Ray2 emitted backward from the semiconductor light-emitting elements 22*b* (22Ab) of the first film light source 22A disposed forward and irradiated backward through the film portion of the second film light source 22B disposed rearward are reflected by the reflector 40, whereby the reflector 40 can be observed as if it were emitting light.

As described above, when the vehicular lamp 10 is to function as a stop lamp, the first film light source 22A and the second film light source 22B can emit light, and further the reflector 40 can be observed as if it were emitting light, so that the second film light source 22B and the reflector 40 which are behind the first film light source 22A and light rays from which pass through the first film light source 22A can be visually recognized. As a result, a stereoscopic lighting appearance having a sense of depth can be realized.

As described above, the film light source supporting unit 24 (24*a* to 24*c*) can support the first and second film light sources 22A and 22B in a state of maintaining a constant shape, for example, a curved shape, of the film light sources. As a result, the semiconductor light-emitting elements 22*b* of the first and second film light sources 22A and 22B are disposed in a three-dimensional manner. This can also realize a stereoscopic lighting appearance having a sense of depth.

In addition, since the lamp unit 20 is placed in the lamp chamber 54 while keeping a space between it and the housing 52, it is possible to realize a lighting appearance that is seen as if the lamp unit 20 were floating in the lamp chamber 54.

As described above, the present exemplary embodiment according to the presently disclosed subject matter can provide the vehicular lamp 10 capable of satisfying the light distribution standard required by certain laws and having a novel lighting appearance that can realize various lighting patterns of various luminances and various light-emitting shapes, e.g., various lighting graphics.

The vehicular lamp 10 can include the first and second film light sources 22A and 22B including a plurality of semiconductor light-emitting elements 22*b* fixed in a state of being disposed two-dimensionally (display-like) on at least the surface of the film 22*a*, and thus, when the plurality of semiconductor light-emitting elements 22*b* can be individually controlled to be turned on or off, various lighting patterns (various lighting graphics) of various luminances and various light-emitting shapes can be realized. The reason why the light distribution standard required by certain laws can be satisfied, in particular, in the case of a stop lamp or a turn signal lamp which is required to have a high luminance, is that a semiconductor light-emitting element having a luminance higher than that of an organic EL is used.

In addition, according to the present exemplary embodiment, it is possible to provide a highly commercialized vehicular lamp having a completely different lighting appearance (lighting pattern) between the case of functioning as a tail lamp and the case of functioning as a stop lamp.

This is because the first film light source 22A and the second film light source 22B are disposed so as to overlap each other in the front-rear direction of the vehicle within the same range as viewed in a front view.

Further, the present exemplary embodiment adopts the first and second film light sources 22A and 22B having flexibility fixed in such a state that the plurality of semiconductor light-emitting elements 22*b* are two-dimensionally disposed. Thus, as compared with a case in which each of the plurality of semiconductor light-emitting elements is individually disposed in a predetermined position with a predetermined posture, all of the plurality of semiconductor light-emitting elements 22*b* can be disposed two-dimensionally or three-dimensionally in a predetermined position at a time by simply supporting the first and second film light sources 22A and 22B in such a state that the film 22*a* maintains a constant shape, for example, a curved shape, by the film light source supporting unit 24 (24*a* to 24*c*).

Further, according to the present exemplary embodiment, the rear surface of the first film light source 22A and the front surface of the intermediate lens 24*b* are in surface contact with each other, and the rear surface of the second film light source 22B and the front surface of the rear lens 24*c* are in surface contact with each other. This configuration can maintain the shapes of the first film light source 22A and the second film light source 22A (shapes of films) in a constant shape, for example, a curved shape.

In the above-mentioned conventional technology (refer to Japanese Patent Application Laid-Open No. 2016-058136), since the organic EL panel functioning as the tail lamp and the organic EL panel functioning as the stop lamp are separately disposed side by side as viewed in a front view, the size of the vehicular lamp as viewed in a front view becomes large.

On the other hand, in this aspect, since the first and second film light sources 22A and 22B are disposed in such a state that they overlap each other in the front-rear direction of the vehicle within the same range as viewed in a front view, that is, in series in the front-rear direction of the vehicle, the size of the vehicular lamp 10 in the front view can be reduced as compared with the case according to the above-mentioned conventional technology.

Further, according to the present exemplary embodiment, it is possible to configure a thin and lightweight lamp unit in which the front lens 24*a*, the intermediate lens 24*b*, and the rear lens 24*c* are fixed in such a state that the first and second film light sources 22A and 22B are disposed between the front lens 24*a* and the intermediate lens 24*b*, and between the intermediate lens 24*b* and the rear lens 24*c*, respectively.

Further, according to the present exemplary embodiment, the rear surface of the first film light source 22A and the front surface of the intermediate lens 24*b* are in surface contact with each other, and the rear surface of the second film light source 22B and the front surface of the rear lens 24*c* are in surface contact with each other. Thus, the shapes of the first film light source 22A and the second film light source 22B (films) can be maintained in a constant shape, for example, a curved shape.

In addition, according to the present exemplary embodiment, the front surface of the first film light source 22A and the rear surface of the front lens 24*a* face each other with the space S1 interposed therebetween, and the front surface of the second film light source 22B and the rear surface of the intermediate lens 24*b* face each other with the space S2 interposed therebetween. Thus, the front surface of the first film light source 22A and the front surface of the second film light source 22B (the plurality of semiconductor light-emitting elements 22*b* mounted on the front surface thereof) are prevented from being damaged by such a contact with the rear surface of the front lens 24*a* and the rear surface of the intermediate lens 24*b*, respectively.

Further, according to the present exemplary embodiment, when the emission color of the semiconductor light-emitting elements 22*b* of the first film light source 22A and the emission color of the semiconductor light-emitting elements 22*b* of the second film light source 22B are the same, a multi-functional vehicular lamp, for example, a tail lamp (red) and a stop lamp (red) can be realized even with the same color by one lamp unit 20.

According to the present exemplary embodiment, a first light distribution pattern, for example, a light distribution pattern for a tail lamp, can be formed by controlling part or all of the plurality of semiconductor light-emitting elements 22*b* of the first film light source 22A and the second film light source 22B to emit light in the first lighting pattern. In addition, a second light distribution pattern, for example, a light distribution pattern for a stop lamp, can be formed by controlling part or all of the plurality of semiconductor light-emitting elements 22*b* to emit light in the second lighting pattern.

Further, according to the present exemplary embodiment, since the films 22*a* of the first and second film light sources 22A and 22B are transparent films, light rays emitted backward by the semiconductor light-emitting elements 22*b* of the first and second film light sources 22A and 22B are transmitted through the film 22*a*. As a result, the light utilization efficiency of the light emitted backward from the semiconductor light-emitting elements 22*b* of the first and second film light sources 22A and 22B is improved.

Further, according to the present exemplary embodiment, the flexible first and second film light sources 22A and 22B are fixed in such a state that the semiconductor light-emitting elements 22*b* having luminance higher than that of an organic EL are two-dimensionally disposed. Thus, it is possible to provide the vehicular lamp 10 which is thin and flexible, and which has a sufficient light amount capable of forming a light distribution pattern for a stop lamp, a light distribution pattern for a turn-signal lamp, or the like.

Next, modified examples will be described.

In the above-described exemplary embodiment, an example in which the vehicular lamp of the presently disclosed subject matter is applied to a vehicular signal lamp such as a tail lamp, a stop lamp, or a turn-signal lamp has been described, but the presently disclosed subject matter is not limited thereto. For example, the vehicular lamp of the presently disclosed subject matter may be applied to general lighting as well as DRL lamps, vehicle interior lighting (e.g., indicators), and warning light.

In the above-described exemplary embodiment, an example in which the emission color of the semiconductor light-emitting elements 22*b* of the first film light source 22A and the emission color of the semiconductor light-emitting elements 22*b* of the second film light source 22B are the same has been described, but the presently disclosed subject matter is not limited thereto. For example, the emission color of the semiconductor light-emitting elements 22*b* of the first film light source 22A and the emission color of the semiconductor light-emitting elements 22*b* of the second film light source 22B may be different from each other.

For example, the emission color of the semiconductor light-emitting elements 22*b* of the first film light source 22A may be red, and the emission color of the semiconductor light-emitting elements 22*b* of the second film light source 22B may be amber.

In this manner, a multi-functional vehicular lamp, for example, a tail lamp (red) and a turn-signal lamp (amber), can be realized in different colors even with one lamp unit 20.

Furthermore, an opaque film may be used as the film 22*a* of the film light source.

In the above-described exemplary embodiment, an example in which the lamp unit 20 is configured using two film light sources 22 including the first and second film light sources 22A and 22B overlapping each other in the front-rear direction of the vehicle has been described, but the presently disclosed subject matter is not limited thereto.

For example, the lamp unit 20 may be configured using film light sources that do not overlap each other in the front-rear direction of the vehicle.

In addition, the lamp unit 20 may be configured using three or more film light sources overlapping each other in the front-rear direction of the vehicle.

Figure 10:
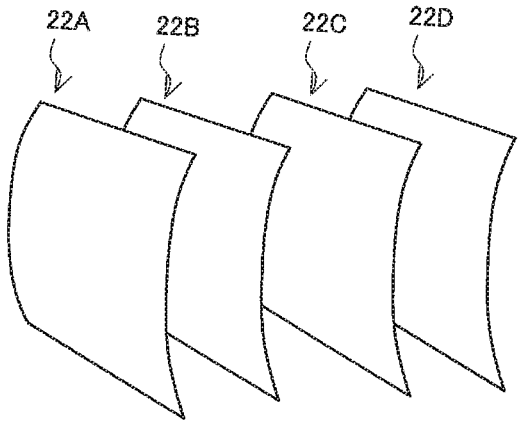
FIG. 10 is a diagram illustrating an example in which the lamp unit is configured by using four film light sources overlapped in the front-rear direction of the vehicle.

FIG. 10 shows an example in which the lamp unit 20 is configured using four film light sources overlapping one another in the front-rear direction of the vehicle. In FIG. 10, reference numeral 22C denotes a film light source for a turn-signal lamp (emission color of a semiconductor light-emitting element is amber), and reference numeral 22D denotes a film light source for a reverse lamp (emission color of a semiconductor light-emitting element is white).

Figure 11A:
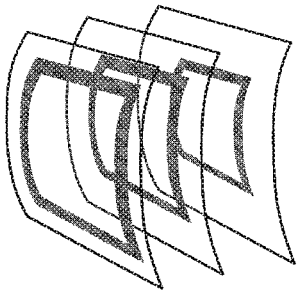
FIGS. 11A and 11B are diagrams each illustrating an example of a lighting pattern of semiconductor light-emitting elements in film light sources.
Figure 11B:
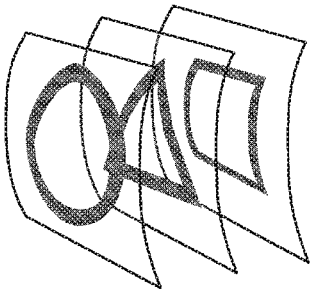

FIGS. 11A and 11B show examples of lighting patterns of the film light sources by the semiconductor light-emitting elements 22*b*.

The lighting pattern of the film light source (semiconductor light-emitting elements 22*b*) may be a lighting pattern having the similar light emission shape and a different size for each film light source as shown in FIG. 11A, or may be a lighting pattern having a different light emission shape for each film light source as shown in FIG. 11B. With this configuration, the sense of depth and stereoscopic effect can be made more conspicuous.

In the above-described exemplary embodiment, an example in which a screw is used as the lens fixing unit 24*d* has been described, but the presently disclosed subject matter is not limited thereto. For example, an engaging unit may be used as the lens fixing unit 24*d*. For example, although not shown, the first pawl portion is provided on the front lens 24*a*, the first hook portion and the second pawl portion are provided on the intermediate lens 24*b*, and the second hook portion is provided on the rear lens 24*c*. Alternatively, the first hook portion is provided on the front lens 24*a*, the first pawl portion and the second hook portion are provided on the intermediate lens 24*b*, and the second pawl portion is provided on the rear lens 24*c*. Then, the first pawl portion and the first hook portion are engaged with each other, and the second pawl portion and the second hook portion are engaged with each other. With this configuration, the front lens 24*a*, the intermediate lens 24*b* and the rear lens 24*c* can be fixed in a state of being positioned with respect to one another.

Figure 12:
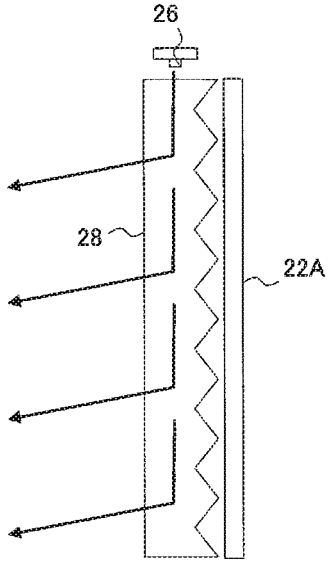
FIG. 12 is a cross-sectional side view illustrating an example in which a light guide plate 28 is to be disposed between a front lens 24*a* and the first film light source 22A to guide the light from the semiconductor light-emitting element 26 and emit the light from the front surface.

FIG. 12 shows an example in which a light guide plate 28 is disposed between the front lens 24*a* and the first film light source 22A to guide the light from a semiconductor light-emitting element 26 and cause the light to be outputted from the front surface. The rear surface of the light guide plate 28 is provided with a structure (lens cut such as a plurality of V-grooves or the like) for controlling light from the semiconductor light-emitting element 26 guided in the light guide plate 28 to be outputted from the front surface thereof.

With this configuration, for example, when the vehicular lamp 10 functions as a tail lamp, part or all of the semiconductor light-emitting elements 22*b* of the first film light source 22A and the second film light source 22B are controlled to emit light in the first lighting pattern as described above, and at the same time, light emitted from the semiconductor light-emitting element 26, which has been turned on, is guided in the light guide plate 28 and caused to be outputted from the front surface, thereby achieving surface emission. In this manner, it is possible to realize a lighting appearance with extremely high aesthetic design in which the first lighting pattern can be made conspicuous within the surface emission as if the first lighting pattern is floating in the surface emission.

Although not shown, another light guide plate may be disposed between the intermediate lens 24*b* and the second film light source 22B to guide the light from another semiconductor light-emitting element and output the light from its front surface.

Next, as another modified example, an example of a lamp unit 20A using the film light source 22 which does not overlap in the front-rear direction of the vehicle will be described with reference to FIG. 13.

Figure 13:
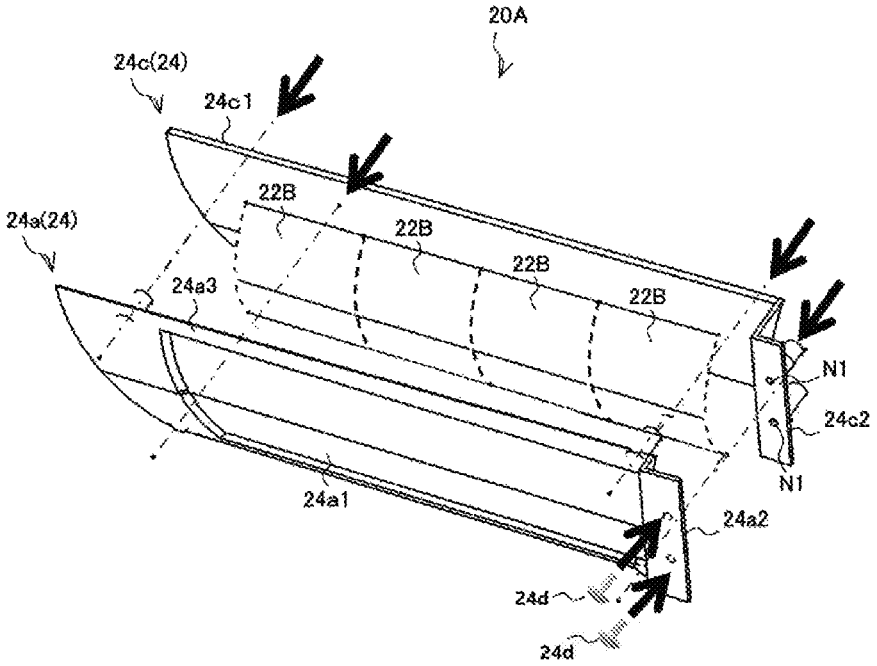
FIG. 13 is a perspective view illustrating a modified example of a lamp unit.

As shown in FIG. 13, the lamp unit 20A of the present modified example corresponds to the lamp unit 20 described in the above-described exemplary embodiment where the first film light source 22A and the intermediate lens 24*b* are omitted from the lamp unit 20. Accordingly, the lamp unit 20A is configured such that the second film light source 22B does not overlap any other film light source. Except for this, the configuration is the same as that of the vehicular lamp 10 described in the above-described exemplary embodiment. The following description will be given of differences from the vehicular lamp 10 described in the above-described exemplary embodiment. In particular, the lighting pattern of the second film light source 22B (semiconductor light-emitting elements 22*b*) will be described as an example when the vehicular lamp 10 using the lamp unit 20A functions as a tail lamp.

When the vehicular lamp 10 using the lamp unit 20A is caused to function as a tail lamp, part or all of the semiconductor light-emitting elements 22*b* of the second film light source 22B are controlled to emit light in a third lighting pattern.

Herein, although not limited thereto, the third lighting pattern is, for example, a pattern in which the semiconductor light-emitting elements 22*b* at portions drawn by a black circle in FIG. 4A out of the semiconductor light-emitting elements 22*b* of the second film light source 22B are controlled to emit light at the first luminance. For example, as another mode of the third lighting pattern, a lighting pattern in which part of the semiconductor light-emitting elements 22*b* in the portions drawn by a black circle in FIG. 4A is turned off or dimmed may be used. As still another mode of the third lighting pattern, a lighting pattern in which luminance of the semiconductor light-emitting elements 22*b* in the portions drawn by a black circle in FIG. 4A changes in a gradation manner may be used. As further another mode of the third lighting pattern, a lighting pattern in which the luminance of each semiconductor light-emitting element 22*b* is controlled to be changed may be used. This makes it possible to express a sense of perspective (sense of depth).

The third lighting pattern is not limited to a static lighting pattern, and may be a dynamic lighting pattern in which the luminance, light emission shape, light emission position, and the like of the semiconductor light-emitting elements 22*b* in the portions drawn by a black circle in FIG. 4A change with time.

As described above, when the semiconductor light-emitting elements 22*b* of the second film light source 22B are controlled to emit light in the third lighting pattern, the light rays Ray1 emitted forward from the semiconductor light-emitting elements 22*b* of the second film light source 22B can form a light distribution pattern for a tail lamp.

Light rays Ray2 emitted from the semiconductor light-emitting elements 22*b* of the second film light source 22B and transmitted through the film 22*a* backward is reflected by the reflector 40, whereby the reflector 40 can be observed as if it were emitting light.

As described above, when the vehicular lamp 10 utilizing the lamp unit 20A is to function as a tail lamp, the second film light source 22B can emit light, and further the reflector 40 can be observed as if it were emitting light, so that the reflector 40 which is behind the second film light source 22B can be visually recognized. As a result, a stereoscopic lighting appearance having a sense of depth can be realized.

Further, as described above, the film light source supporting unit 24 (24*a* to 24*c*) supports the second film light source 22B in a state of maintaining a constant shape, for example, a curved shape, of the film light source. As a result, the semiconductor light-emitting elements 22*b* of the second film light source 22B are three-dimensionally disposed. This also realizes a stereoscopic lighting appearance having a sense of depth.

In addition, since the lamp unit 20A is placed in the lamp chamber 54 while keeping a space between it and the housing 52, it is possible to realize a lighting appearance as if the lamp unit 20A were floating in the lamp chamber 54.

Next, an example of a lighting pattern when the vehicular lamp 10 using the lamp unit 20A is caused to function as a stop lamp will be described.

When the vehicular lamp 10 using the lamp unit 20A is caused to function as a stop lamp, part or all of the semiconductor light-emitting elements 22*b* of the second film light source 22B are controlled to emit light in a fourth lighting pattern which is different from the third lighting pattern.

Although not limited thereto, the fourth lighting pattern is, for example, a pattern in which the semiconductor light-emitting elements 22*b* in the portions drawn by a black circle in FIG. 4B out of the semiconductor light-emitting elements 22*b* of the second film light source 22B are controlled to emit light at the second luminance (where the second luminance>the first luminance). For example, as another mode of the fourth lighting pattern, a lighting pattern in which part of the semiconductor light-emitting elements 22*b* in the portions drawn by a black circle in FIG. 4B is turned off or dimmed may be used. As still another mode of the fourth lighting pattern, a lighting pattern in which luminance of the semiconductor light-emitting elements 22*b* in the portions drawn by a black circle in FIG. 4B changes in a gradation manner as a whole may be used. As further another mode of the fourth lighting pattern, a lighting pattern in which the luminance of each semiconductor light-emitting element 22*b* is controlled to be changed may be used. This makes it possible to express a sense of perspective (sense of depth).

The fourth lighting pattern is not limited to a static lighting pattern, and may be a dynamic lighting pattern in which the luminance, light emission shape, light emission position, and the like of the semiconductor light-emitting elements 22*b* in the portions drawn by a black circle in FIG. 4B change with time.

As described above, when the semiconductor light-emitting elements 22*b* of the second film light source 22B are controlled to emit light in the fourth lighting pattern, the light rays Ray1 emitted forward from the semiconductor light-emitting elements 22*b* of the second film light source 22B can form a light distribution pattern for a stop lamp.

In addition, the light rays Ray2 emitted backward from the semiconductor light-emitting elements 22*b* of the second film light source 22B and transmitted through the film 22*a* are reflected by the reflector 40, whereby the reflector 40 can be observed as if it were emitting light.

As described above, when the vehicle lighting 10 using the lamp unit 20A is to function as a stop lamp, the second film light source 22B can emit light, and the reflector 40 can be observed as if it were emitting light, so that the reflector 40 can be visually recognized through the second film light source 22B. As a result, a stereoscopic lighting appearance having a sense of depth can be realized.

Further, as described above, the film light source supporting unit 24 (24*a* to 24*c*) can support the second film light source 22B in a state of maintaining a constant shape, for example, a curved shape, of the film light source. As a result, the semiconductor light-emitting elements 22*b* of the second film light source 22B are disposed in a three-dimensional manner. This can also realize a stereoscopic lighting appearance having a sense of depth.

In addition, since the lamp unit 20A is placed in the lamp chamber 54 while keeping a space between it and the housing 52, it is possible to realize a lighting appearance as if the lamp unit 20A floats in the lamp chamber 54.

As described above, according to the present modified example, in addition to the effects of the above-described exemplary embodiment, it is possible to configure the thin and lightweight lamp unit 20A in which the front lens 24*a* and the rear lens 24*c* are fixed in such a state that the second film light source 22B is disposed between the front lens 24*a* and the rear lens 24*c*.

In addition, according to the present modified example, since the rear surface of the second film light source 22B and the front surface of the rear lens 24*c* are in surface contact with each other, the shape of the second film light source 22B (film 22*a*) can be maintained in a constant shape, for example, a curved shape.

In addition, according to the present modified example, since the front surface of the second film light source 22B and the rear surface of the front lens 24*a* face each other with a space interposed therebetween, the front surface of the second film light source 22B (or the plurality of semiconductor light-emitting elements 22*b* mounted on the front surface thereof) is prevented from being damaged by such a contact or the like with the rear surface of the front lens 24*a*.

According to the present modified example, even a single film light source, for example, the second film light source 22B, can form a light distribution pattern for a tail lamp and a light distribution pattern for a stop lamp.

All of the numerical values shown in the above-described exemplary embodiments are exemplified, and it is needless to say that an appropriate numerical value different from this can be used.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp comprising:

a plurality of film light sources each including a film having flexibility and a plurality of semiconductor light-emitting elements fixed in a state of being two-dimensionally disposed on at least a surface of the film; and a film light source supporting unit including a front lens, an intermediate lens, a rear lens, and a lens fixing unit configured to fix the front lens, the intermediate lens, and the rear lens, wherein the plurality of film light sources are disposed in a state of overlapping each other in a front-rear direction of a vehicle within a same range as viewed in a front view, the plurality of film light sources include at least a first film light source and a second film light source, and the lens fixing unit fixes the front lens, the intermediate lens, and the rear lens in such a state that the first film light source is disposed between the front lens and the intermediate lens, that the second film light source is disposed between the intermediate lens and the rear lens, that a front surface of the first film light source and a rear surface of the front lens face each other with a space interposed therebetween, and that a front surface of the second film light source and a rear surface of the intermediate lens face each other with a space interposed therebetween.

2. The vehicular lamp according to claim 1, wherein a first light distribution pattern is formed by controlling part or all of the plurality of semiconductor light-emitting elements to emit light in the first lighting pattern.

3. The vehicular lamp according to claim 2, wherein a second light distribution pattern is formed by controlling part or all of the plurality of semiconductor light-emitting elements to emit light in the second lighting pattern.

4. The vehicular lamp according to claim 3, wherein the range within which the plurality of film light sources are disposed is a range satisfying the area requirement required by a certain law.

5. The vehicular lamp according to claim 1, wherein the semiconductor light-emitting elements of each of the plurality of film light sources are not mutually overlapped with the semiconductor light-emitting elements of the other film light source as viewed in a front view, and are disposed in a state of overlapping with a film portion of the other film light source where no semiconductor light-emitting element is disposed.

6. The vehicular lamp according to claim 1, wherein the intermediate lens and the rear lens are curved, the first film light source is curved along a front surface of the intermediate lens by bringing a rear surface of the first film light source into surface contact with the front surface of the intermediate lens, and the second film light source is curved along a front surface of the rear lens by bringing a rear surface of the second film light source into surface contact with the front surface of the rear lens.

7. The vehicular lamp according to claim 1, wherein emission color of the semiconductor light-emitting elements of the first film light source and emission color of the semiconductor light-emitting elements of the second film light source are the same.

8. The vehicular lamp according to claim 7, wherein the first light distribution pattern is formed by controlling part or all of the plurality of semiconductor light-emitting elements of the first film light source and the second film light source to emit light in a third lighting pattern.

9. The vehicular lamp according to claim 8, wherein the second light distribution pattern is formed by controlling part or all of the plurality of semiconductor light-emitting elements of the first film light source and the second film light source to emit light in a fourth lighting pattern.

10. The vehicular lamp according to claim 1, wherein emission color of the semiconductor light-emitting elements of the first film light source and emission color of the semiconductor light-emitting elements of the second film light source are different from each other.

11. The vehicular lamp according to claim 1, wherein the film is a transparent film.

12. The vehicular lamp according to claim 1, wherein the plurality of semiconductor light-emitting elements are each an LED chip, and the plurality of semiconductor light-emitting elements are mounted on the film in such a state that a surface of the LED chip on a side where an electrode pad is provided is opposed to the surface of the film.

* * * * *